US008098221B2

(12) United States Patent
Song et al.

(10) Patent No.: US 8,098,221 B2
(45) Date of Patent: Jan. 17, 2012

(54) LIQUID CRYSTAL DISPLAY AND METHOD OF DRIVING THE SAME

(75) Inventors: Hongsung Song, Gumi-si (KR); Woongki Min, Daegu (KR); Yonggi Son, Milyang-si (KR); Suhyuk Jang, Daegu (KR)

(73) Assignee: LG Display Co., Ltd., Seoul (KR)

( * ) Notice: Subject to any disclaimer, the term of this patent is extended or adjusted under 35 U.S.C. 154(b) by 584 days.

(21) Appl. No.: 12/318,153

(22) Filed: Dec. 22, 2008

(65) Prior Publication Data

US 2009/0284456 A1 Nov. 19, 2009

(30) Foreign Application Priority Data

May 19, 2008 (KR) ..... 10-2008-0046226

(51) Int. Cl.
*G09G 3/36* (2006.01)

(52) U.S. Cl. ..... 345/94; 345/99

(58) Field of Classification Search ..... 345/87, 345/94, 95, 99, 100
See application file for complete search history.

(56) References Cited

U.S. PATENT DOCUMENTS

| | | | | |
|---|---|---|---|---|
| 7,145,544 | B2 * | 12/2006 | Oohira | 345/99 |
| 7,522,184 | B2 * | 4/2009 | Sun | 348/53 |
| 7,570,239 | B2 * | 8/2009 | Cheon et al. | 345/87 |
| 7,643,001 | B2 * | 1/2010 | Oohira | 345/99 |
| 2004/0085371 | A1 | 5/2004 | Lee et al. | |
| 2008/0074410 | A1 | 3/2008 | Kim et al. | |
| 2009/0051641 | A1 | 2/2009 | Irie et al. | |

FOREIGN PATENT DOCUMENTS

| | | | |
|---|---|---|---|
| CN | 1499478 | A | 5/2004 |
| JP | 2002-358056 | | 12/2002 |
| JP | 2007-206676 | | 8/2007 |
| WO | WO 2007135803 | A1 | 11/2007 |

* cited by examiner

*Primary Examiner* — Ricardo L Osorio
(74) *Attorney, Agent, or Firm* — McKenna Long & Aldridge LLP

(57) ABSTRACT

A liquid crystal display (LCD) capable of improving display quality and a method of driving the same are provided. The LCD comprises an LCD panel including a plurality of data lines and gate lines and liquid crystal cells arranged in a matrix at crossings of the gate lines and the data lines, a driving circuit for supplying a data voltage to the data lines and for supplying a scan pulse to the gate lines, a timing controller for generating a gate start pulse for indicating a start horizontal line in which scanning starts in a one frame period where one screen is displayed, a control clock generator for counting the number of frames using the gate start pulse and for generating a control clock whenever an accumulated count value becomes a multiple of a predetermined value, and a common voltage generating circuit for generating control data of a specific bit based on the control clock and for generating a common voltage whose level varies in stages per predetermined interval using the control data to supply the common voltage to the LCD panel.

11 Claims, 5 Drawing Sheets

| Block \ Frame | (N ~ N+199) th Frame | (N+200 ~ N+399) th Frame | (N+400 ~ N+599) th Frame | (N+600 ~ N+799) th Frame | (N+800 ~ N+999) th Frame | (N+1000 ~ N+1199) th Frame |
|---|---|---|---|---|---|---|
| BL1 | S2 | S3 | S4 | S3 | S2 | S1 |
| BL2 | S3 | S4 | S3 | S2 | S1 | S0 |
| BL3 | S4 | S3 | S2 | S1 | S0 | S1 |
| BL4 | S3 | S2 | S1 | S0 | S1 | S2 |
| BL5 | S2 | S1 | S0 | S1 | S2 | S3 |

LIQUID CRYSTAL DISPLAY AND METHOD OF DRIVING THE SAME

This application claims the benefit of Korea patent Application No. 10-2008-0046226 filed on May 19, 2008, which is hereby incorporated by reference for all purpose as if fully set forth herein.

BACKGROUND OF THE INVENTION

1. Field of the Invention

The present invention relates to a liquid crystal display (LCD) capable of improving display quality and a method of driving the same.

2. Discussion of the Related Art

A liquid crystal display (LCD) controls the transmittance of a liquid crystal layer through an electric field applied to the liquid crystal layer in response to a video signal to display an image. The LCD is a flat panel display (FPD) that is small and thin and that consumes a small amount of power and is used as a portable computer such as a notebook PC, an office automation apparatus, and audio/video apparatuses. In particular, since an active matrix type LCD in which switching devices are formed in liquid cells, respectively, can actively control the switching devices, it is advantageous to realizing a moving picture.

A thin film transistor (hereinafter, referred to as TFT) illustrated in FIG. 1 is mainly used as the switching device used for the active matrix type LCD.

Referring to FIG. 1, the active matrix type LCD converts digital video data into an analog data voltage based on a gamma reference voltage to supply the analog data voltage to a data line DL and supplies a scan pulse to a gate line GL to charge the data voltage in a liquid crystal cell Clc. Therefore, the gate electrode of the TFT is connected to the gate line GL, the source electrode of the TFT is connected to the data line DL, and the drain electrode of the TFT is connected to the pixel electrode of the liquid crystal cell Clc and one side electrode of a storage capacitor Cst1. A common voltage Vcom is supplied to the common electrode of the liquid crystal cell Clc. The storage capacitor Cst1 charges the data voltage applied from the data line DL when the TFT is turned on to maintain the voltage of the liquid crystal cell Clc to be uniform. When the scan pulse is applied to the gate line GL, the TFT is turned on to form a channel between the source electrode and the drain electrode and to supply the voltage on the data line DL to the pixel electrode of the liquid crystal cell Clc. At this time, the arrangement of the liquid crystal molecules of the liquid crystal cell Clc is changed by an electric field between the pixel electrode and the common electrode to modulate incident light.

When a direct current (DC) voltage is applied to the liquid crystal layer of the LCD for a long time, ions having negative charges move in the one motion vector direction and ions having positive charges move in the other motion vector direction to be polarized in accordance with the polarity of the electric field applied to liquid crystal layer and the accumulation amount of the ions having the negative charges and the accumulation amount of the ions having the positive charges increase with the lapse of time. As the accumulation amount of the ions increases, an alignment layer deteriorates. As a result, the alignment characteristic of the liquid crystal deteriorates. Therefore, when the DC voltage is applied to the LCD for a long time, spots appear in a displayed image and the spots increase with the lapse of time. In order to reduce the spots, a method of developing a liquid crystal material having a low permittivity or of improving an alignment material or an alignment method was attempted. However, such a method requires a large amount of time and cost for developing a material. When the permittivity of the liquid crystal is reduced, another problem of deteriorating the driving characteristic of the liquid crystal occurs. As noted by experiments, the point of time at which the spots appear due to the polarization and accumulation of the ions gets faster as impurities ionized in the liquid crystal layer increase and accelerating factors are large. The accelerating factor are temperature, time, the DC driving of the liquid crystal. Therefore, the spots appear faster and get severe as the temperature is higher or the time for which the DC voltage of the same polarity is applied to the liquid crystal layer is longer. Furthermore, since the shapes and degrees of the spots are different in the panels of the same model that are manufactured through the same manufacturing line, it is not possible to remove the spots by developing a new material or by improving processes.

SUMMARY OF THE INVENTION

Accordingly, the present invention is directed to a liquid crystal display and method of driving the same that substantially obviates one or more of the problems due to limitations and disadvantages of the related art.

An advantage of the present invention to provide a liquid crystal display (LCD) capable of sequentially varying the level of a common voltage applied to a liquid crystal layer at specific frame intervals to prevent spots generated by the polarization and accumulation of ions and to improve display quality and a method of driving the same.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, there is provided a liquid crystal display (LCD), comprising an LCD panel including a plurality of data lines and gate lines and liquid crystal cells arranged in a matrix at crossings of the gate lines and the data lines, a driving circuit for supplying a data voltage to the data lines and for supplying a scan pulse to the gate lines, a timing controller for generating a gate start pulse for indicating a start horizontal line in which scanning starts in a one frame period where one screen is displayed, a control clock generator for counting the number of frames using the gate start pulse and for generating a control clock whenever an accumulated count value becomes a multiple of a predetermined value, and a common voltage generating circuit for generating control data of a specific bit based on the control clock and for generating a common voltage whose level varies in stages per predetermined interval using the control data to supply the common voltage to the LCD panel.

In another aspect of the present invention, there is provided a liquid crystal display (LCD) having an LCD panel including a plurality of data lines and gate lines and liquid crystal cells arranged in a matrix at crossings of the gate lines and the data lines, and is divided to be driven in units of horizontal blocks, a driving circuit for supplying a data voltage to the data lines and for supplying a scan pulse to the gate lines, a timing controller for generating a gate start pulse for indicating a start horizontal line in which scanning starts in a one frame period where one screen is displayed, a control clock generator for counting the number of frames using the gate start pulse to generate a first control clock whenever an accumulated count value becomes a multiple of a predetermined value and for counting the number of horizontal lines in the same frame using a data enable signal from the outside to generate a second control clock whenever the horizontal block changes, and a common voltage generating circuit for generating control data of a specific bit based on the first and second control clocks and for generating a common voltage whose level varies in stages per predetermined interval and having different levels between adjacent horizontal blocks using the control data to supply the common voltage to the LCD panel.

In another aspect of the invention, there is provided a method of driving a liquid crystal display (LCD) having an LCD panel including a plurality of data lines and gate lines and liquid crystal cells arranged in a matrix at crossings of the gate lines and the data lines, and a driving circuit for supplying a data voltage to the data lines and for supplying a scan pulse to the gate lines, the method comprising generating a gate start pulse for indicating a start horizontal line in which scanning starts in one frame period where one screen is displayed, counting the number of frames using the gate start pulse and generating a control clock whenever an accumulated count value becomes a multiple of a predetermined value, and generating control data of a specific bit based on the control clock and generating a common voltage whose level varies in stages per predetermined interval using the control data to supply the common voltage to the LCD panel.

In another aspect of the invention, there is provided a method of driving a liquid crystal display (LCD) having an LCD panel including a plurality of data lines and gate lines and liquid crystal cells arranged in a matrix at crossings of the gate lines and the data lines, and is divided to be driven in units of horizontal blocks, and a driving circuit for supplying a data voltage to the data lines and for supplying a scan pulse to the gate lines, the method comprising generating a gate start pulse for indicating a start horizontal line in which scanning starts in a one frame period where one screen is displayed, counting the number of frames using the gate start pulse to generate a first control clock whenever an accumulated count value becomes a multiple of a predetermined value and counting the number of horizontal lines in the same frame using a data enable signal from the outside to generate a second control clock whenever the horizontal block changes, and generating control data of a specific bit based on the first and second control clocks and for generating a common voltage whose level varies in stages per predetermined interval and having different levels between adjacent horizontal blocks using the control data to supply the common voltage to the LCD panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are comprised to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENTS

Reference will now be made in detail to an embodiment of the present invention, example of which is illustrated in the accompanying drawings.

Hereinafter, embodiments of the present invention will be described in detail with reference to FIGS. 2 to 10.

Figure 1:
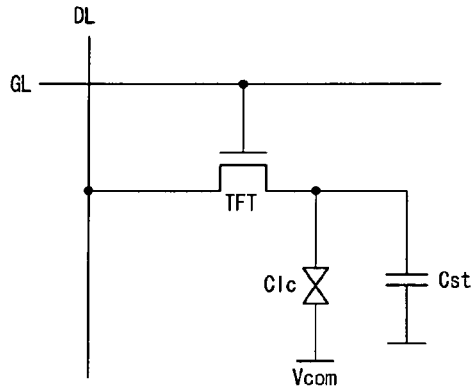
FIG. 1 (Related Art)
FIG. 1 is an equivalent circuit diagram of the pixel of a common liquid crystal display (LCD)
Figure 2:
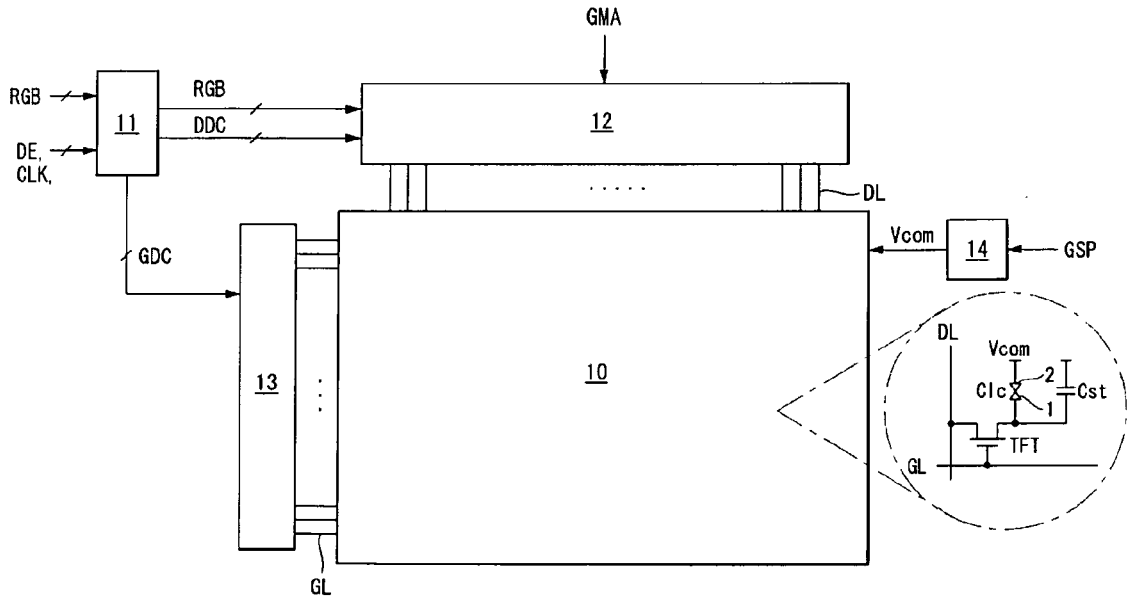
FIG. 2 is a block diagram of an LCD according to an embodiment of the present invention.

Referring to FIG. 2, a liquid crystal display (LCD) according to an embodiment of the present invention comprises an LCD panel 10, a timing controller 11, a data driving circuit 12, a gate driving circuit 13, and a common voltage generating circuit 14.

In the LCD panel 10, a liquid crystal layer is formed between two glass substrates. The LCD panel comprises m×n liquid crystal cells Clc arranged in a matrix at the intersections between m data lines DL and n gate lines GL.

The data lines DL, the gate lines GL, thin film transistors (TFT), and a storage capacitor Cst are formed on the lower glass substrate of the LCD panel 10. The liquid crystal cells Clc are connected to the TFTs to be driven by an electric field between a pixel electrode 1 and a common electrode 2. A black matrix, a color filter, and the common electrode 2 are formed on the upper glass substrate of the LCD panel 10. The common electrode 2 is formed on the upper glass substrate in a vertical electric field driving method such as a twisted nematic (TN) mode and a vertical alignment (VA) mode, however, the common electrode 2 can be formed on the lower glass substrate together with the pixel electrode 1 in a horizontal electric field driving method such as an in plane switching (IPS) mode and a fringe field switching (FFS) mode. Polarizing plates are attached to the upper glass substrate and the lower glass substrate of the LCD panel 10 and an alignment layer for setting the pre-tilt angle of liquid crystal is formed.

The timing controller 11 receives timing signals such as a data enable (DE) signal and a dot clock CLK signal to generate control signals GDC and DDC for controlling the operation timings of the data driving circuit 12 and the gate driving circuit 13.

The gate timing control signal GDC for controlling the operation timing of the gate driving circuit 13 comprises a gate start pulse (GSP) for indicating a start horizontal line in which scanning starts in a first vertical period where a screen is displayed, a gate shift clock (GSC) signal that is a timing control signal input to a shift register in the gate driving circuit 13 to sequentially shift the gate start pulse (GSP) and that is generated to have a pulse width corresponding to the on period of the TFTs, and a gate output enable (GOE) signal for indicating the output of the gate driving circuit 13.

The data timing control signal DDC for controlling the operation timing of the data driving circuit 12 comprises a source sampling clock (SSC) for indicating the latch operation of data in the data driving circuit 12 based on a rising or falling edge, a source output enable (SOE) signal for indicating the output of the data driving circuit 12, and a polarity controlling signal POL for indicating the polarity of a data voltage to be supplied to the liquid crystal cells Clc of the LCD panel 10.

In addition, the timing controller 11 re-aligns digital video data RGB input from an external system board in accordance with the resolution of the LCD panel 10 to supply the re-aligned digital video data RGB to the data driving circuit 12.

The data driving circuit 12 converts the digital video data RGB into an analog gamma correcting voltage based on gamma reference voltages GMA from a gamma reference voltage generating unit (not shown) in response to the data control signal DDC from the timing controller 11 and supplies the analog gamma correcting voltage to the data lines DL of the LCD panel 10 as a data voltage. Therefore, the data driving circuit 12 consists of a plurality of data drive ICs comprising a shift register for sampling a clock signal, a register for temporarily storing the digital video data RGB, a latch for storing data by one line in response to the clock signal from the shift register and for simultaneously outputting the stored data by one line, a digital/analog converter for selecting positive/negative gamma voltages with reference to the gamma reference voltage in response to the digital data value from the latch, a multiplexer for selecting the data line DL to which analog data converted by the positive/negative gamma voltages are supplied, and an output buffer connected between the multiplexer and the data line DL.

The gate driving circuit 13 sequentially supplies a scan pulse for selecting the horizontal line of the LCD panel 10 to which the data voltage is to be supplied to the gate lines GL. Therefore, the gate driving circuit 13 consists of a plurality of gate drive ICs comprising a shift register, a level shifter for converting the output signal of the shift register into a swing width suitable for driving the TFT of the liquid crystal cell Clc, and an output buffer connected between the level shifter and the gate line GL.

Figure 7:
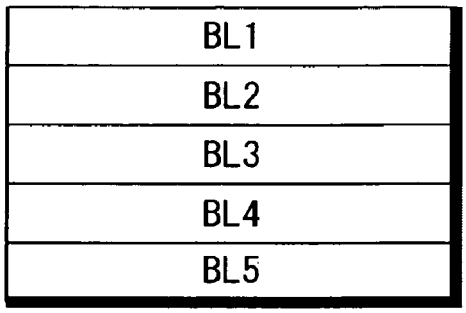
FIG. 7 illustrates an LCD panel divided and driven in units of horizontal blocks according to another embodiment of the present invention.

The common voltage generating circuit 14 generates a common voltage whose level varies in stages every predetermined uniform time (for example, 200 frames) with reference to the gate start pulse (GSP) supplied from the timing controller 11 to supply the generated common voltage to the common electrode 2 of the LCD panel 10. In addition, the common voltage generating circuit 14 generates the common voltage whole level varies in stages every predetermined uniform time (for example, 200 frames) with reference to the gate start pulse (GSP) supplied from the timing controller 11 so that the common voltage varies between adjacent horizontal blocks in the same frame with reference to the data enable signal DE as illustrated in FIG. 7 to supply the generated common voltage to the common electrode 2 of the LCD panel 10. The common voltage generating circuit 14 will be described in detail with reference to FIGS. 3 and 8.

Figure 3:
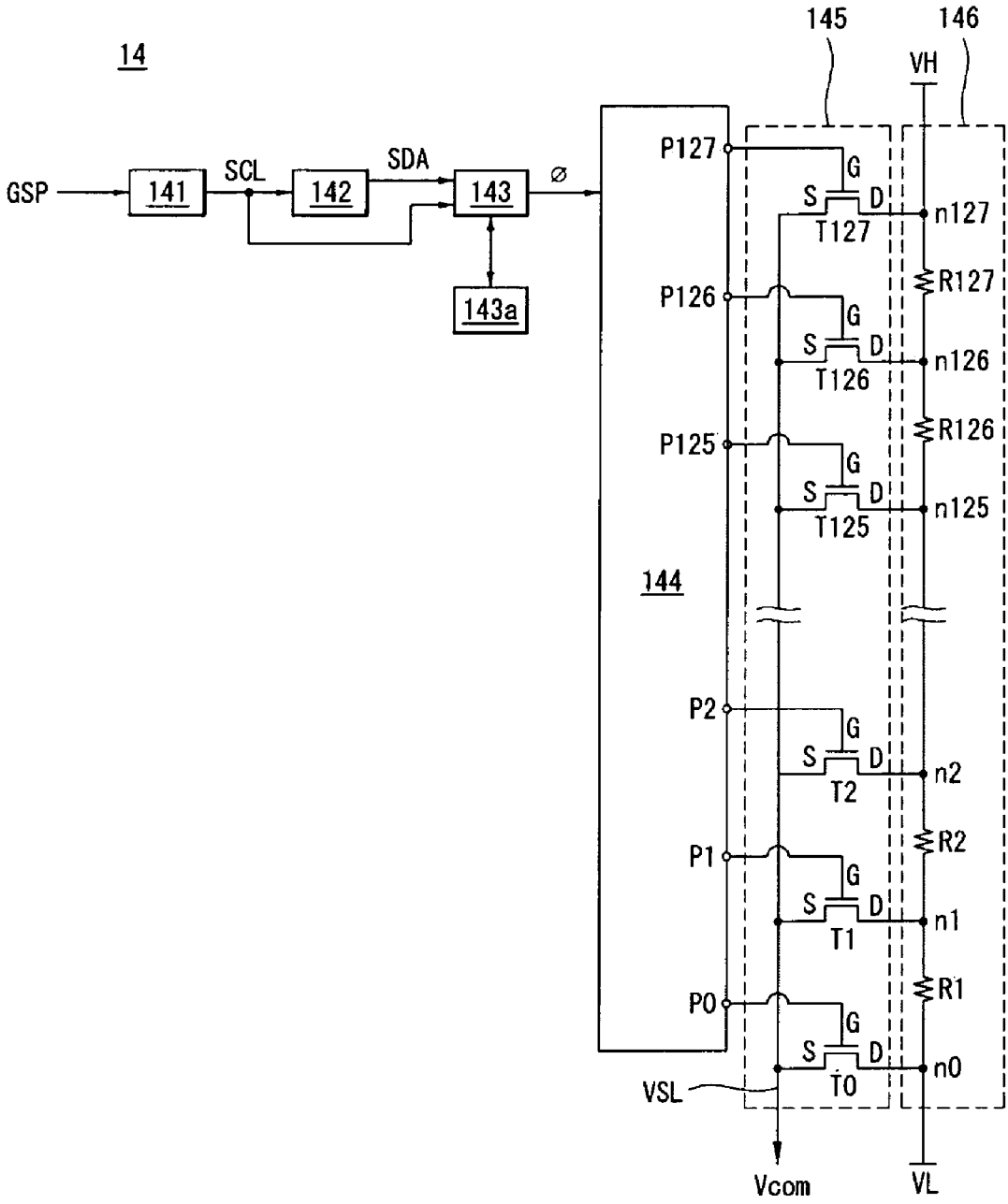
FIG. 3 illustrates a common voltage generating circuit according to an embodiment of the present invention in detail.

FIG. 3 illustrates the common voltage generating circuit 14 according to an embodiment of the present invention in detail.

Referring to FIG. 3, the common voltage generating circuit 14 comprises a control clock generating unit 141, a control data generating unit 142, a register 143, a memory 143*a*, a decoder 144, a switch array 145, and a resistance string 146.

Figure 4:
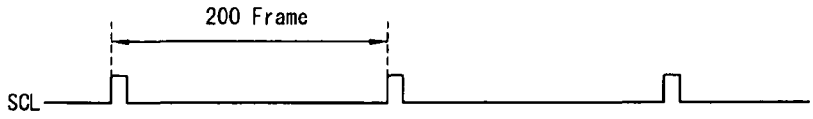
FIG. 4 illustrates the waveform of a control clock according to an embodiment of the present invention.

The control clock generating unit 141 comprising a frame counter, counts the number of frames in synchronization with the gate start pulse (GSP) supplied from the timing controller 11 and generates the control clock SCL illustrated in FIG. 4 whenever the accumulated count value becomes the multiple of the predetermined value (for example, 200). The control clock SCL is generated at 200 frame intervals. Here, the predetermined value 200 is a value indicating the point of time at which spots caused by the polarization and accumulation of ions can appear by applying the DC voltage of the same polarity to the liquid crystal layer and can be set to be smaller or larger than 200 in consideration of the influence of a temperature.

The control clock generating unit 141 can be embedded in the timing controller 11 instead of being embedded in the common voltage generating circuit 14.

The control data generating unit 142 generates control data SDA of a specific bit (for example, 7 bits) in synchronization with the control clock SCL from the control clock generating unit 141. When the control data SDA has 7 bits, the binary code value of the control data SDA is sequentially and repeatedly increased and reduced between 111 1110(2) and 000 0000(2) in synchronization of the control clock SCL. Therefore, the control data SDA sequentially increased and reduced between 0 to 127 levels in synchronization with the control clock SCL is generated. Therefore, the control data generating unit 142 can be realized by a linear feedback shift register (LFSR). The LFSR is a shift register whose input bit is linear with respect to a previous state and can generate a bit progression having a period as long as it looks almost random only if a feedback function is properly selected. On the other hand, the control data SDA is not limited to 7 bits and can have bits smaller or larger than 7 bits.

The memory 143*a* comprises a non-volatile memory capable of updating and erasing data, for example, an electrically erasable programmable read only memory (EEPROM) and/or an extended display identification data (EDID) ROM and stores the control data SDA increased and reduced in synchronization with the control clock SCL and a switch control signal $\phi$ corresponding to the control data SDA using a look-up table.

The register 143 reads the switch control signal $\phi$ stored in the memory 143*a* using the control data SDA from the control data generating unit 142 as a read address in accordance with the control clock SCL to supply the read switch control signal $\phi$ to a decoder 144. The switch control signal $\phi$ output from the register 143 can be formed of a digital signal of 7 bits.

The decoder 144 decodes the switch control signal $\phi$ from the register 143 to output the decoded switch control signal $\phi$ through an output pin corresponding to the digital value of the switch control signal $\phi$. The decoder 144 comprises 128 output pins P0 to P127 to correspond to the switch control signal $\phi$ of 7 bits. The output pins P0 to P127 are connected one to one to the gate terminals G of the switches T0 to T127 that constitute the switch array 145.

The switch array 145 comprises the plurality of switches T0 to T127. The gate terminals G of the switches T0 to T127 are connected one to one to the output pins P0 to P127 of the decoder 144 to receive the switch control signal $\phi$. The drain terminals D of the switches T0 to T127 are one to one connected to divided voltage output nodes n1 to n127 formed in the resistance string 146 between adjacent resistors R1 to R127. The source terminals S of the switches T0 to T127 are commonly connected to a common voltage supply wire VSL. Therefore, one of the switches T0 to T127 is turned on in response to the switch control signal ϕ from the decoder 144 to select one of the plurality of divided voltages as a common voltage Vcom to be supplied to the common electrode 2.

Figure 5:
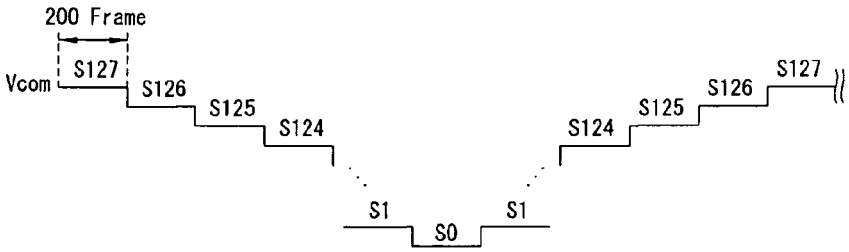
FIG. 5 illustrates a common voltage increased and reduced with 128 multi-steps according to an embodiment of the present invention.

In the resistance string 146, as described above, a plurality of resistors R0 to R127 are serially connected between a high potential power voltage VH and a low potential power voltage VL and the plurality of divided voltages having different levels are generated through the divided voltage output nodes n1 to n127 between the resistors. As illustrated in FIG. 5, the divided voltages become the common voltage Vcom having 128 multi-steps S0 to S127 sequentially increased and reduced every 200 frames between 0 to 127 levels.

Figure 6:
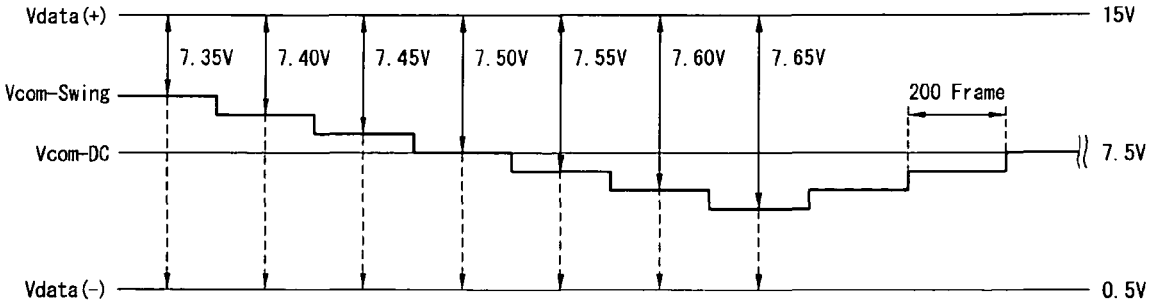
FIG. 6 illustrates a common voltage increased and reduced with 7 multi-steps according to an embodiment of the present invention.

FIG. 6 illustrates a common voltage Vcom_Swing increased and reduced having 7 multi-steps as another example of the multi-steps according to the present invention. In FIG. 6, Vdata(+) illustrates a positive data voltage, Vdata (−) illustrates a negative data voltage, and Vcom_DC illustrates a DC common voltage.

As illustrated in FIG. 6, it is noted that the common voltage Vcom_Swing according to an embodiment of the present invention swings using the 7 multi-steps that change every 200 frames. Therefore, although the data voltage is uniformly supplied to a liquid crystal cell for a long time, the voltage charged in the liquid cell by the swing of the common voltage Vcom_Swing continuously varies every 200 frames. For example, when the positive data voltage Vdata(+) of 15V is uniformly supplied for a long time, the voltage actually charged in the corresponding liquid cell is increased in stages from 7.35V to 7.65V from the first step to the seventh step and is reduced in stages from 7.65V to 7.35V from the seventh step to the $13^{th}$ step by the swing of the common voltage Vcom_Swing. On the other hand, when the negative data voltage Vdata(−) of 0.5V is uniformly supplied for a long time, the voltage actually charged in the corresponding liquid cell is reduced in stages from the first step to the seventh step and is increased in stages from the seventh step to the $13^{th}$ step. Therefore, the polarization and accumulation of the ions caused by the DC voltage of the same polarity applied to the liquid crystal cell for a long time are prevented.

Figure 8:
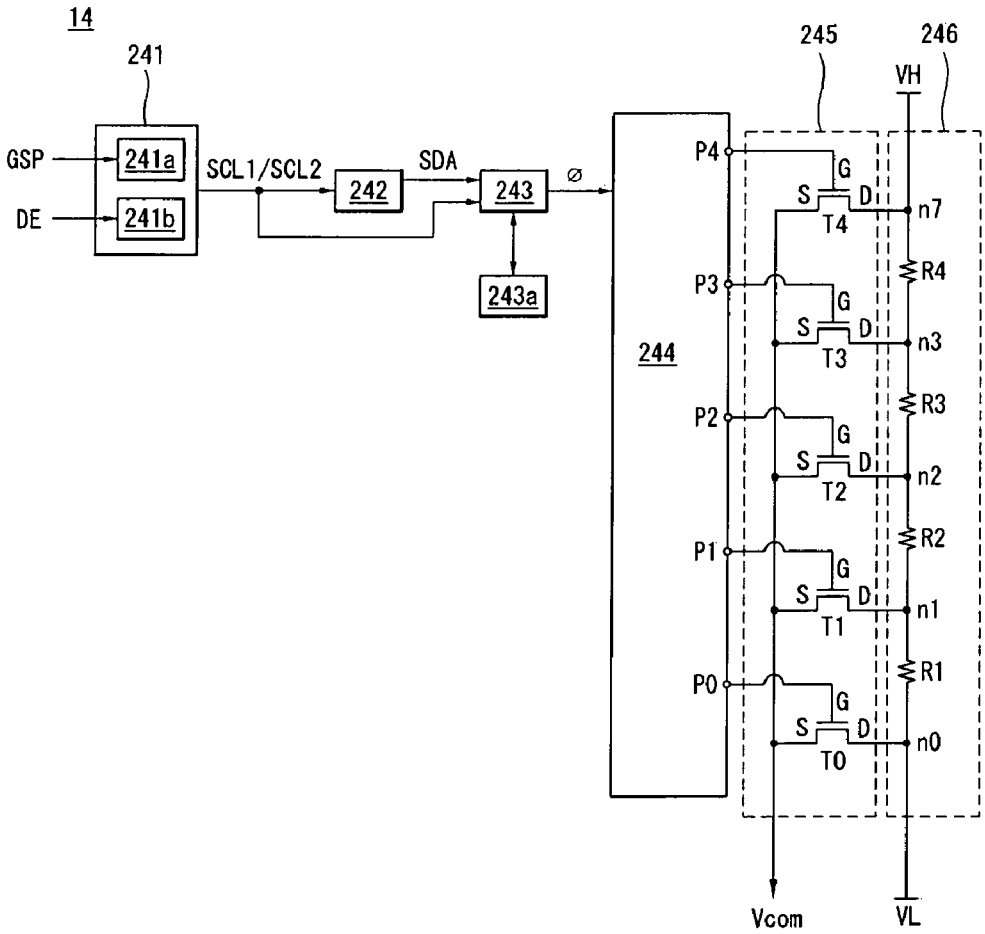
FIG. 8 illustrates a common voltage generating circuit according to another embodiment of the present invention in detail.

FIG. 7 illustrates that the LCD panel is divided to be driven in units of horizontal blocks in the same frame by the common voltage of different levels. FIG. 8 illustrates the common voltage generating circuit 14 according to another embodiment of the present invention capable of performing division driving as illustrated in FIG. 7. In FIG. 7, one horizontal block comprises at least one horizontal line.

Referring to FIG. 8, the common voltage generating circuit 14 comprises a control clock generating unit 241, a control data generating unit 242, a register 243, a memory 243*a*, a decoder 244, a switch array 245, and a resistance string 246.

The control clock generating unit 241 comprising a frame counter 241*a* counts the number of frames in synchronization with the gate start pulse (GSP) supplied from the timing controller 11 and generates a first control clock SCL1 whenever the accumulated count value becomes the multiple of the predetermined value (for example, 200). Here, the predetermined value 200 is a value indicating the point of time at which spots caused by the polarization and accumulation of ions can appear by applying the DC voltage of the same polarity to the liquid crystal layer and can be set to be smaller or larger than 200 in consideration of the influence of a temperature. In addition, the control clock generating unit 241 comprising a line counter 241*b* counts the number of horizontal lines in the same frame in synchronization with the data enable signal DE and generates a second control clock SCL2 whenever the accumulated count value is changed to a predetermined value, that is, a horizontal block changes. Therefore, the first control clock SCL1 is generated at 200 frame intervals and the second control clock SCL2 is generated at the intervals of the point of time at which the horizontal block changes in the same frame.

The control clock generating unit 241 can be embeded in the timing controller 11 instead of being embeded in the common voltage generating circuit 14.

The control data generating unit 242 generates control data SDA of a specific bit (for example, 3 bits) in synchronization with the first and second control clocks SCL1 and SCL2 from the control clock generating unit 241. When the control data SDA has 3 bits, the binary code value of the control data SDA is sequentially and repeatedly increased and reduced between 100(2) and 000(2) in synchronization of the first and second control clocks SCL1 and SCL2. Therefore, the control data SDA sequentially increased and reduced between 0 to 4 levels in synchronization with the first control clock SCL is generated. The control data SDA is sequentially increased and reduced between the 0 to 4 levels in synchronization with the second control clock SCL2. Therefore, the control data generating unit 242 can be realized by a linear feedback shift register (LFSR). The LFSR is a shift register whose input bit is linear with respect to a previous state and can generate a bit progression having a period as long as it looks almost random only if a feedback function is properly selected. On the other hand, the control data SDA is not limited to 3 bits and can have bits smaller or larger than 3 bits.

The memory 243*a* comprises a non-volatile memory capable of updating and erasing data, for example, an electrically erasable programmable read only memory (EEPROM) and/or an extended display identification data (EDID) ROM and stores the control data SDA increased and reduced in synchronization with the control clock SCL and a switch control signal ϕ corresponding to the control data SDA using a look-up table.

The register 243 reads the switch control signal ϕ stored in the memory 243*a* using the control data SDA from the control data generating unit 242 as a read address in accordance with the first and second control clocks SCL1 and SCL2 to supply the read switch control signal ϕ to a decoder 244. The switch control signal ϕ output from the register 243 can be formed of a digital signal of 3 bits.

The decoder 244 decodes the switch control signal ϕ from the register 243 to output the decoded switch control signal ϕ through an output pin corresponding to the digital value of the switch control signal ϕ. The decoder 244 comprises 5 output pins P0 to P4 to correspond to the switch control signal ϕ of 3 bits. The output pins P0 to P4 are connected one to one to the gate terminals G of the switches T0 to T4 that constitute the switch array 245.

The switch array 245 comprises the plurality of switches T0 to T4. The gate terminals G of the switches T0 to T4 are connected one to one to the output pins P0 to P4 of the decoder 244 to receive the switch control signal ϕ. The drain terminals D of the switches T0 to T4 are one to one connected to divided voltage output nodes n1 to n4 formed in the resistance string 246 between adjacent resistors R1 to R4. The source terminals S of the switches T0 to T4 are commonly connected to a common voltage supply wire VSL. Therefore, one of the switches T0 to T4 is turned on in response to the switch control signal ϕ from the decoder 244 to select one of the plurality of divided voltages as a common voltage Vcom to be supplied to the common electrode 2.

Figures 9, 10:
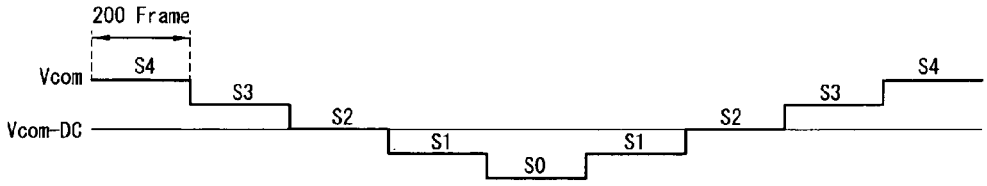
FIG. 9 illustrates a common voltage increased and reduced with 5 multi-steps according to another embodiment of the present invention.
FIG. 10 illustrates the levels of the common voltage by frames supplied to horizontal blocks according to another embodiment of the present invention.

In the resistance string 246, as described above, a plurality of resistors R0 to R4 are serially connected between a high potential power voltage VH and a low potential power voltage VL and the plurality of divided voltages having different levels are generated through the divided voltage output nodes n1 to n4 between the resistors. Therefore, the common voltage Vcom realized by the divided voltages, as illustrated in FIG. 9, has 5 multi-steps S0 to S4 sequentially increased and reduced every 200 frames between 0 to 4 levels. The common voltage Vcom having the 0 to 4 levels, as illustrated in FIG. 10, is supplied to horizontal blocks BL1 to BL5 with different levels between adjacent horizontal blocks in the same frame. The common voltage Vcom having the 5 multi-steps S0 to S4 increased and reduced between the 0 to 4 levels is supplied to the same horizontal block in stages.

As described above, in the LCD according to the present invention and the method of driving the same, the level of the common voltage applied to the liquid crystal layer sequentially varies per predetermined interval so that the direction and intensity of the electric field vector formed in the liquid crystal layer can be dispersed. Therefore, the spots generated by the polarization and accumulation of the ions can be prevented so that it is possible to remarkably improve display quality.

In addition, in the LCD according to the present invention and the method of driving the same, the level of the common voltage applied to the liquid crystal layer sequentially varies per predetermined interval and in units of the horizontal blocks so that the direction and intensity of the electric field vector formed in the liquid crystal layer can be effectively dispersed. Therefore, the spots generated by the polarization and accumulation of the ions can be prevented so that it is possible to remarkably improve display quality.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display (LCD), comprising:

an LCD panel including a plurality of data lines and gate lines and liquid crystal cells arranged in a matrix at crossings of the gate lines and the data lines;

a driving circuit for supplying a data voltage to the data lines and for supplying a scan pulse to the gate lines;

a timing controller for generating a gate start pulse for indicating a start horizontal line in which scanning starts in a one frame period where one screen is displayed;

a control clock generator for counting a number of frames using the gate start pulse and for generating a control clock whenever an accumulated count value becomes a multiple of a predetermined value; and a common voltage generating circuit for generating control data of a specific bit based on the control clock and for generating a common voltage whose level varies in stages per predetermined interval using the control data to supply the common voltage to the LCD panel.

2. The LCD of claim 1, wherein the common voltage generating circuit comprises:

a control data generating unit for generating control data of a specific bit whose digital value is increased and reduced in stages per predetermined interval in synchronization with the control clock;

a memory for storing the control data increased and reduced in synchronization with the control clock and a switch control signal corresponding to the control data in a look-up table;

a register for reading the switch control signal stored in the memory using the control data as a read address;

a decoder for decoding the read switch control signal to be output;

a resistance string for dividing a high potential power voltage and a low potential power voltage to generate a plurality of voltages having different levels, respectively; and a switch array for connecting one of a plurality of divided voltage output nodes formed in the resistance string in response to the decoded switch control signal to a supply wire for supplying the common voltage.

3. The LCD of claim 1, wherein a generation period of the control clock is determined in consideration with a degree of polarization and accumulation of ions in a liquid crystal layer in accordance with temperature and time at which a DC voltage is applied to the liquid crystal layer of the LCD panel.

4. The LCD of claim 1, wherein the control clock generating unit is embeded in the timing controller or the common voltage generating circuit.

5. A liquid crystal display (LCD), comprising:

an LCD panel including a plurality of data lines and gate lines and liquid crystal cells arranged in a matrix at crossings of the gate lines and the data lines, and is divided to be driven in units of horizontal blocks;

a driving circuit for supplying a data voltage to the data lines and for supplying a scan pulse to the gate lines;

a timing controller for generating a gate start pulse for indicating a start horizontal line in which scanning starts in a one frame period where one screen is displayed;

a control clock generator for counting a number of frames using the gate start pulse to generate a first control clock whenever an accumulated count value becomes a multiple of a predetermined value and for counting the number of horizontal lines in the same frame using a data enable signal from the outside to generate a second control clock whenever the horizontal block changes; and a common voltage generating circuit for generating control data of a specific bit based on the first and second control clocks and for generating a common voltage whose level varies in stages per predetermined interval and having different levels between adjacent horizontal blocks using the control data to supply the common voltage to the LCD panel.

6. The LCD of claim 5, wherein the common voltage generating circuit comprises:

a control data generating unit for generating control data of a specific bit whose digital value is increased and reduced in stages per predetermined interval and whose digital value varies before and after a point of time at which the horizontal block changes in synchronization with the first and second control clocks;

a memory for storing the control data increased and reduced in synchronization with the first and second control clocks and a switch control signal corresponding to the control data in a look-up table;

a register for reading the switch control signal stored in the memory using the control data as a read address;

a decoder for decoding the read switch control signal to be output;

a resistance string for dividing a high potential power voltage and a low potential power voltage to generate a plurality of voltages having different levels, respectively; and a switch array for connecting one of a plurality of divided voltage output nodes formed in the resistance string in response to the decoded switch control signal to a supply wire for supplying the common voltage.

7. The LCD of claim 1, wherein a generation period of the first and second control clocks is determined in consideration with a degree of polarization and accumulation of ions in a liquid crystal layer in accordance with temperature and time at which a DC voltage is applied to the liquid crystal layer of the LCD panel.

8. A method of driving a liquid crystal display (LCD) having an LCD panel including a plurality of data lines and gate lines and liquid crystal cells arranged in a matrix at crossings of the gate lines and the data lines, and a driving circuit for supplying a data voltage to the data lines and for supplying a scan pulse to the gate lines, the method comprising:

generating a gate start pulse for indicating a start horizontal line in which scanning starts in one frame period where one screen is displayed;

counting the number of frames using the gate start pulse and generating a control clock whenever an accumulated count value becomes a multiple of a predetermined value; and generating control data of a specific bit based on the control clock and generating a common voltage whose level varies in stages per predetermined interval using the control data to supply the common voltage to the LCD panel.

9. The method of claim 8, wherein generating the common voltage comprises:

generating control data of a specific bit whose digital value is increased and reduced in stages per predetermined interval in synchronization with the control clock;

storing the control data increased and reduced in synchronization with the control clock and a switch control signal corresponding to the control data in a look-up table;

reading the switch control signal stored in the memory using the control data as a read address;

decoding the read switch control signal to be output; and dividing a high potential power voltage and a low potential power voltage to connect one of a plurality of divided voltage output nodes formed in a resistance string for generating a plurality of voltages having different levels to a supply wire for supplying the common voltage in response to the decoded switch control signal.

10. A method of driving a liquid crystal display (LCD) having an LCD panel including a plurality of data lines and gate lines and liquid crystal cells arranged in a matrix at crossings of the gate lines and the data lines, and is divided to be driven in units of horizontal blocks, and a driving circuit for supplying a data voltage to the data lines and for supplying a scan pulse to the gate lines, the method comprising:

generating a gate start pulse for indicating a start horizontal line in which scanning starts in a one frame period where one screen is displayed;

counting the number of frames using the gate start pulse to generate a first control clock whenever an accumulated count value becomes a multiple of a predetermined value and counting the number of horizontal lines in the same frame using a data enable signal from the outside to generate a second control clock whenever the horizontal block changes; and generating control data of a specific bit based on the first and second control clocks and for generating a common voltage whose level varies in stages per predetermined interval and having different levels between adjacent horizontal blocks using the control data to supply the common voltage to the LCD panel.

11. The method of claim 10, wherein generating the common voltage comprises:

generating control data of a specific bit whose digital value is increased and reduced in stages per predetermined interval and whose digital value varies before and after a point of time at which the horizontal block changes in synchronization with the first and second control clocks;

storing the control data increased and reduced in synchronization with the first and second control clocks and a switch control signal corresponding to the control data in a look-up table;

reading the switch control signal stored in the memory using the control data as a read address;

decoding the read switch control signal to be output; and dividing a high potential power voltage and a low potential power voltage to connect one of a plurality of divided voltage output nodes formed in a resistance sting for generating a plurality of voltages having different levels to a supply wire for supplying the common voltage in response to the decoded switch control signal.

* * * * *